US005274853A

United States Patent [19]

Millican

[11] Patent Number: 5,274,853

[45] Date of Patent: Jan. 4, 1994

[54] ADJUSTABLE SHIRT COLLAR

[76] Inventor: Robert D. Millican, 1800 Watrous, #36A, Des Moines, Iowa 50315

[21] Appl. No.: 955,417

[22] Filed: Oct. 2, 1992

Related U.S. Application Data

[63] Continuation of Ser. No. 790,361, Nov. 12, 1991.

[51] Int. Cl.[5] ..... A41B 3/02

[52] U.S. Cl. ..... 2/141.2; 2/141.1; 2/129; 2/131; 2/115

[58] Field of Search ..... 2/141

[56] References Cited

U.S. PATENT DOCUMENTS

| | | | |
|---|---|---|---|
| 906,905 | 12/1908 | Loncle | 2/141 R |
| 985,612 | 2/1911 | Maciarz | 2/129 |
| 1,110,187 | 9/1914 | Cooper | 2/141 |
| 1,396,204 | 11/1921 | Hess et al. | 2/141 R |
| 1,424,918 | 8/1922 | Kennedy et al. | 2/141 R |
| 1,771,101 | 7/1930 | Rubinstein | 2/141 R |
| 1,792,369 | 2/1931 | Goldberg | 2/141 A |
| 2,086,907 | 7/1937 | Goldschmidt | 2/141 R |
| 2,178,777 | 11/1939 | Chapel | 2/141 R |
| 2,286,281 | 6/1942 | Jacks | 2/141 R |
| 2,585,690 | 2/1952 | Schafer | 2/127 |
| 3,345,645 | 10/1967 | DiAddario | 2/115 |
| 3,430,264 | 3/1969 | Beukenkamp, Jr. | 2/141 R |
| 4,648,137 | 3/1987 | Cooper | 2/141 R |
| 4,937,884 | 7/1990 | Sherman | 2/129 |

FOREIGN PATENT DOCUMENTS

| | | | |
|---|---|---|---|
| 440498 | 5/1925 | Fed. Rep. of Germany | 2/141 R |
| 2383618 | 11/1978 | France | 2/141 R |
| 365067 | 11/1938 | Italy | 2/131 |
| 180668 | 2/1936 | Switzerland | 2/141 R |
| 6848 | 3/1909 | United Kingdom | 2/141 R |
| 162885 | 3/1920 | United Kingdom | 2/141 R |
| 465818 | 8/1935 | United Kingdom | 2/141 R |

*Primary Examiner*—Clifford D. Crowder
*Assistant Examiner*—Gloria Hale
*Attorney, Agent, or Firm*—Zarley, McKee, Thomte, Voorhees & Sease

[57] ABSTRACT

An adjustable shirt collar has an integral tab extension on the stand element of the collar. The extension has a length to it to span the distance across the necktie space on the front of the shirt from underneath one end of the shirt collar element to a termination area underneath the other end of the collar element. An adjustable fastening apparatus is secured to the collar stand in the termination area to be connected to a connector element on the extension to permit the adjustment position to be effected. The tab extension is curved slightly upwardly above the upper edge of the stand element and the collar element to permit the collar element, the stand element and the tab extension to adjust to the curvature of the wearers neck and to dwell in substantially a common plane around the wearers neck.

1 Claim, 1 Drawing Sheet

ADJUSTABLE SHIRT COLLAR

This application is a continuation of U.S. Ser. No. 790,361, filed Nov. 12, 1991.

BACKGROUND OF THE INVENTION

Men's shirt collars are normally sized in half inch increments, which means that they are in the order of one-quarter inch too small or too large for many wearers. Compensating snaps, loops, and other extension devices have been created to cope with this problem, but all have proven to be generally impractical, and have never been generally accepted It is therefore a principal object of this invention to provide a shirt collar that can have its circumferential size selectively adjusted.

A further object of this invention is to provide a size-adjustable shirt collar that will not interfere with the necktie space of the shirt.

A still further object of this invention is to provide a size adjustable shirt collar that will retain a neat and refined appearance regardless of the degree of the adjustment.

A still further object of this invention is to provide a size adjustable shirt collar which can be easily adjusted.

A still further object of this invention is to provide a size adjustable shirt collar wherein the adjustment elements are essentially hidden from view.

These and other objects will be apparent to those skilled in the art.

BRIEF SUMMARY OF THE INVENTION

An integral tab extension is on one end of the stand element of the collar. The extension has a length to permit it to span the distance across the necktie space on the front of the shirt from underneath one end of the shirt collar element to a termination area underneath the other end of the collar element. An adjustable fastening apparatus is secured to the collar stand in the termination area to be connected to a connector element on the extension to permit the adjustment position to be effected. The tab extension is curved slightly upwardly above the upper edge of the stand element and the collar element to permit the collar element, the stand element and the tab extension to adjust to the curvature of the wearers neck and to dwell in substantially a common plane around the wearers neck.

DESCRIPTION OF THE PREFERRED EMBODIMENT

Figure 1:
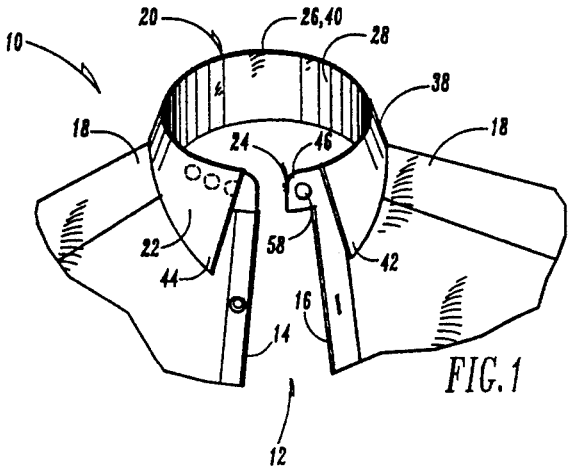
FIG. 1 is a partial frontal perspective view of a shirt utilizing this invention.
Figure 2:
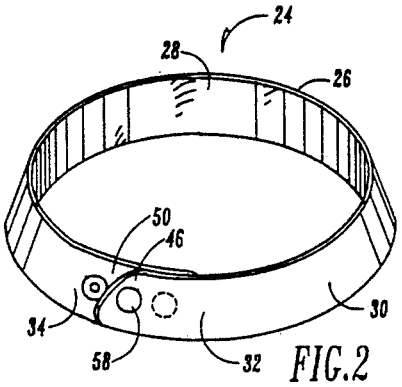
FIG. 2 is a frontal perspective view of the stand element of the collar of this invention with the collar element and shirt removed.
Figure 3:
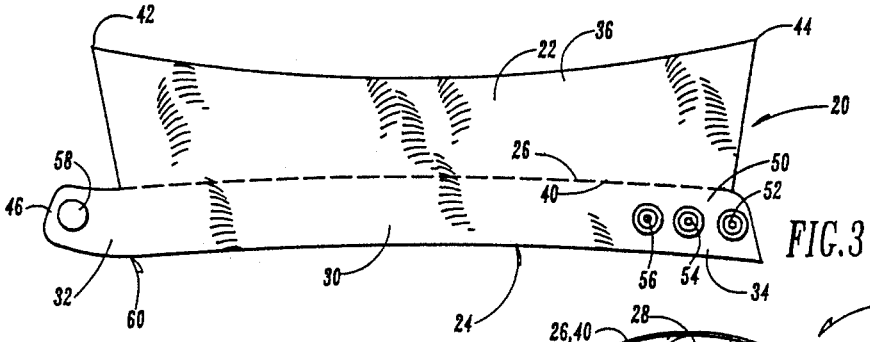
FIG. 3 is a plan view of the collar of this invention in an unfolded condition with the shirt removed.
Figure 4:
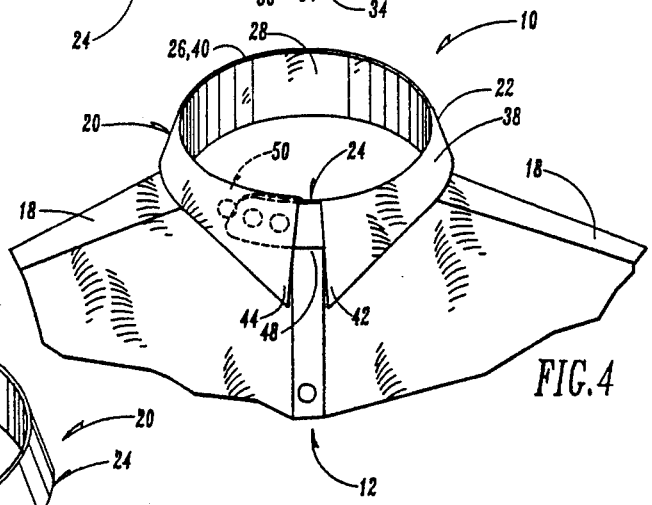
FIG. 4 is an enlarged scale frontal perspective view similar to that of FIG. 1 but with the collar in a closed and fastened condition.
Figure 5:
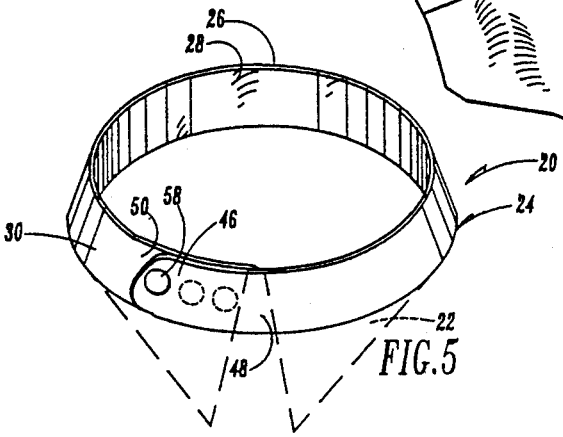
FIG. 5 is a view similar to that of FIG. 2, but shows a different adjustment position.

The numeral 10 designates a conventional shirt, except for the collar. Shirt 10 has a front 12 with vertical front closure edges 14 and 16, and shoulder portions 18.

The shirt collar 20 is comprised of collar element 22 and collar stand 24. The stand 24 has an elongated top edge 26, inner surface 28, and outer surface 30, and opposite ends 32 and 34. The collar element 22 has inner surface 36, outer surface 38, an elongated top edge 40, and opposite tip ends 42 and 44. The collar element and collar stand are connected at their respective top edges.

The ends 32 and 34 of stand 24 extend beyond the ends 42 and 44 of collar element 22 (FIG. 1). The stand 24 has a tab extension 46 at end 32 which normally extends across the necktie space 48 and terminates in termination area 50 underneath collar element end 44 when in its operative position. A plurality of male fastener elements 52, 54 and 56 are secured to end 34 of stand 24 in the termination area 50, and normally dwell underneath collar element end 44. A female fastener element 58 is secured to tab extension 46 and is adapted for connection to any of the fastener elements 52, 54 or 56.

The tab extension is curved upwardly about 30° at point 60. That curvature is important to permit the collar element, stand element and tab extension to adjust to the curvature of the wearers neck and to also dwell in substantially a common plane. Without this curvature, some "buckling" or distortion of the tab extension will occur when fastener 58 is connected.

A Velcro® type fastener could be substituted for fastener elements 52–58. Fastener element 58 can be attached to the desired fastener elements 52, 54 or 56 to accommodate the size of the wearers neck. It is seen that the necktie space is preserved regardless of which combination of fasteners is used.

From the foregoing, it is seen that this invention will accomplish at least all of its stated objectives.

I claim:

1. A combination shirt and shirt collar, comprising:

a shirt comprising shoulder portions, and a front having opposite vertical front closure edges, an elongated stand element on said shirt to encircle a wearer's neck and having an elongated top edge; inner and outer surfaces; and opposite ends; with only one of said ends being in vertical alignment with only one of said front closure edges, an elongated collar element having inner and outer surfaces, straight opposite ends, an elongated top edge secured to and coextensive with said top edge of said stand element, and normally folded downwardly over the outer surface of said stand element;

the ends of said stand element extending beyond the ends of said collar element to create a necktie space to accommodate a necktie knot; said ends of said collar element being spaced apart and out of engagement with each other to define said necktie space, a tab extension on only one end of said stand element and being of integral one-piece construction with said stand element, said tab extension having a length to permit it to span the distance across said necktie space from underneath one end of said collar element to a termination area underneath the other end of said collar element and on the other end of said stand element, and adjustable fastening means connecting said tab extension and said other end of said stand element in said termination area, said fastening means comprising a first fastener means on said tab extension compatible and connectable with second fastener means having a plurality of fastening positions on said other end of said stand element in said termination area; said first and second fastener means being so positioned that said necktie space will exist and said ends of said collar element will be spaced and out of engagement with each other regardless of which of said fastening positions said first fastener means is connection, the end of said stand element adjacent said tab extension being free from any fastening means thereon.

* * * * *